United States Patent [19]

Yorita

[11] Patent Number: 4,760,222

[45] Date of Patent: Jul. 26, 1988

[54] VACUUM CIRCUIT INTERRUPTER

[75] Inventor: Mitsumasa Yorita, Amagasaki, Japan

[73] Assignee: Mitsubishi Denki Kabushiki Kaisha, Japan

[21] Appl. No.: 99,747

[22] Filed: Sep. 22, 1987

[30] Foreign Application Priority Data

Sep. 29, 1986 [JP] Japan ..... 61-232038

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,903,386 | 9/1975 | Yanagisawa | 200/144 B |
| 3,920,942 | 11/1975 | Yanagisawa | 200/144 B |
| 4,231,814 | 11/1980 | Watanabe | 200/144 B |
| 4,440,995 | 4/1984 | Lange et al. | 200/144 B |

FOREIGN PATENT DOCUMENTS

| | | | |
|---|---|---|---|
| 53-43490 | 10/1978 | Japan | 200/144 B |
| 53-43491 | 10/1978 | Japan . | |

*Primary Examiner*—Robert S. Macon

*Attorney, Agent, or Firm*—Leydig Voit & Mayer

[57] ABSTRACT

A vacuum circuit interrupter comprising in a vacuum vessel at least a pair of a separable stationary electrode and a movable electrode, and a main shield concentrically surrounding the electrodes. The main shield has a large-diameter portion at the central portion and a small-diameter portion at opposite ends. The axial length L of the large-diameter portion of the main shield is the length expressed by:

$$L = \text{stationary electrode thickness } t_1 + \text{electrode gap length } t_2 + \text{movable electrode thickness } t_3 + 2\frac{(\phi_2 + \phi_1)}{2}\tan(45° \sim 75°)$$

where, $\Phi_2$=inner diameter of the large-diameter portion of main shield, and $\Phi_1$=outer diameter of the electrode. The taper angle from the large-diameter portion to the small-diameter portion is selected to be 80°~100°.

4 Claims, 2 Drawing Sheets

$$\ell_1 = (\phi_2 - \phi_1)/2 \cdot \tan\theta$$

VACUUM CIRCUIT INTERRUPTER

BACKGROUND OF THE INVENTION

This invention relates to a shield structure for a vacuum switching circuit interrupter.

FIG. 1 is a sectional view showing the structure of a conventional vacuum circuit interrupter as disclosed in Japanese Utility Model Publication No. 53-43491, for example.

In the figure, the vacuum circuit interrupter comprises an electrically insulating cylinder made of a glass or a ceramic material. A first flange 4 is attached to the upper end of the insulating tube 1 through a cylindrical sealing member 3, and a second flange 6 is attached to the lower end of the insulating tube 1 through a cylindrical sealing member 5. The first flange 4 has secured at its center a stationary electrode rod 8 having a stationary electrode 7 at its lower end, and the second flange 6 has secured at its center an axially expandable bellows 9, and the other end of the bellows 9 has mounted thereon a movable electrode rod 11 having at its tip a movable electrode 10 opposing the stationary electrode 7. The electrode rods 8 and 11 are axially aligned, and the insulating tube 1, the sealing members 3 and 5, the flanges 4 and 6, and the bellows 9 together constitute a vacuum vessel 12. To the insulating cylinder 1 a central portion of a cylindrical main shield 13 of a circular cross-section and suitably curved to surround the electrodes 7 and 10 to have a diameter smaller at the opposite ends than that of the central portion is mounted. Also, on the inner surface of the first flange 4 an outer shield 14 is provided, and the lower end of the outer shield 14 is formed to concentrically overlap the upper end of the main shield 13 and be radially spaced from the outside through by a suitable gap therebetween. Also on the upper surface of the second flange 6 an outer shield 15 is provided and the uppeer end of of outer shield 15 and the lower end of the main shield 13 are formed in a relationship similar to the above. Further, a bellows shield 16 surrounding the bellows 9 is mounted to the movable electrode rod 11.

The operation of the conventional vacuum circuit interrupter will now be described. When the electrodes 7 and 10 are opened while an electric current flows through the electrode rods 8 and 11, an electric arc is generated across the electrodes 7 and 10.

This arc melts the electrodes 7 and 10 and generates metal vapor which is allowed to diffuse into the vacuum space. In order to prevent pollution of the insulating vessel 1 by the metal vapor, the main shield 13 is provided thereby to trap most of the metal vapor.

This phenomenon occurs when the space between the electrodes 7 and 10 and the main shield 13 is large, and when the vacuum interrupter is very compact the arc generated across the electrodes 7 and 10 is driven to the outer periphery of the electrodes 7 and 10 by a magnetic field generated by the arc, often causing the main shield 13 to melt.

Since the conventional vacuum interrupter is constructed as described above, particles or small fragments of the melted main shield 13 are scattered in the axial direction of the main shield 13 and, after they reach the curved portions, they also scatter and condense in the radial direction. Therefore, the distances between the electrode 7 and the shield 13 as well as the electrode 10 and the shield 13 are shortened, decreasing the dielectric recovery characteristics during current interruption and the withstand voltage characteristics and after current interruption.

SUMMARY OF THE INVENTION

Accordingly, an object of the present invention is to provide a vacuum circuit interrupter in which the above discussed problems are eliminated.

Another object of the present invention is to provide a vacuum circuit interrupter in which the dielectric recovery characteristics during current interruption and the withstand voltage characteristics after current interruption are not degraded.

With the above objects in view, the vacuum circuit interrupter of the present invention includes a shield structure which comprises with the positions of both electrodes as references, a main shield having a large-diameter portion at the central portion and a small-diameter portion at opposite ends. The length of the large-diameter portion is suitably selected, and the taper angle from the large-diameter portion to the small-diameter portion is selected to be 80°~100°.

The shield structure of the present invention is for effectively receiving the particles of the main shield so that the adverse effects of the scattering of the particles from the melted main shield are reduced.

BRIEF DESCRIPTION OF THE DRAWINGS

The present invention will become more readily apparent from the following detailed description of the preferred embodiment taken in conjunction with the accompanying drawings, in which.

Throughout the figures, the same reference numerals designate identical or corresponding components.

DESCRIPTION OF THE PREFERRED EMBODIMENTS

Figure 3:
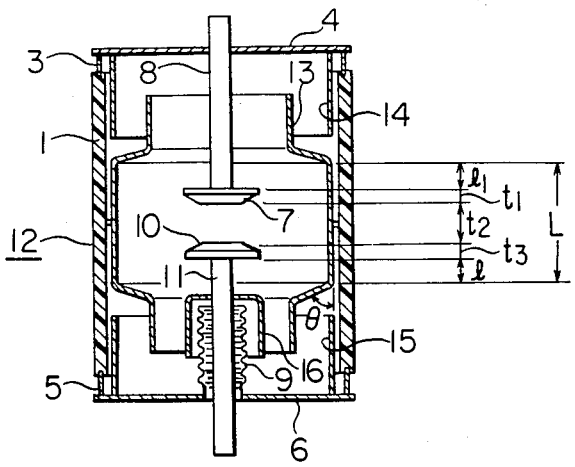
FIG. 3 is a cross sectional view showing a vacuum interrupter of one embodiment of the present invention.

In FIG. 3, 1 is an electrically insulating cylinder made of glass or ceramics, and a first flange 4 is attached to the upper end of the insulating cylinder 1 through a cylindrical sealing member 3, and a second flange 6 is attached to the lower end of the insulating cylinder 1 through a cylindrical sealing member 5. At the central portion of the first flange 4, a stationary electrode rod 8 having a stationary electrode 7 at its lower end portion is secured, and at the central portion of the second flange 6, an axially extending bellows 9 is secured, and at the other end of the bellows 9, a movable electrode rod 11 having at its tip a movable electrode 10 facing the stationary electrode 7 is attached.

The electrodes 8 and 11 are axially aligned, and the insulating cylinder 1, the sealing members 3 and 5, the flanges 4 and 6 and the bellows 9 together constitute a vacuum vessel 12.

Within the insulating cylinder 1, a main shield 13 is disposed so as to surround the electrodes 7 and 10. This main shield has a large-diameter portion in the central portion and small-diameter portions at opposite ends, with the length of the large-diameter portion suitably selected and the tapered angle of the transition from the large-diameter portion to the small-diameter portion is made within a range of 80°~100°.

On the first flange 4 and the second flange 6, outer shields 14 and 15 are concentrically formed relative to the main shield 13 with a proper gap therebetween.

Figure 1:
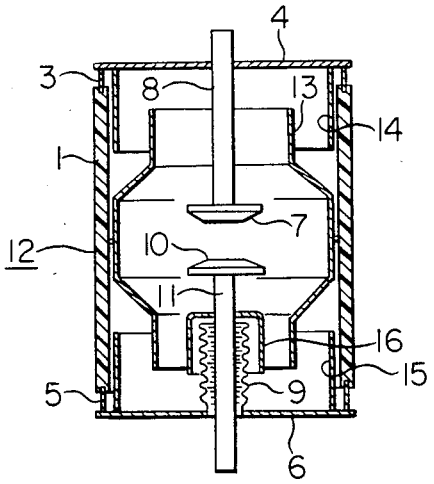
FIG. 1 PRIOR ART
FIG. 1 is a cross sectional view showing the conventional vacuum interrupter.
Figure 2:
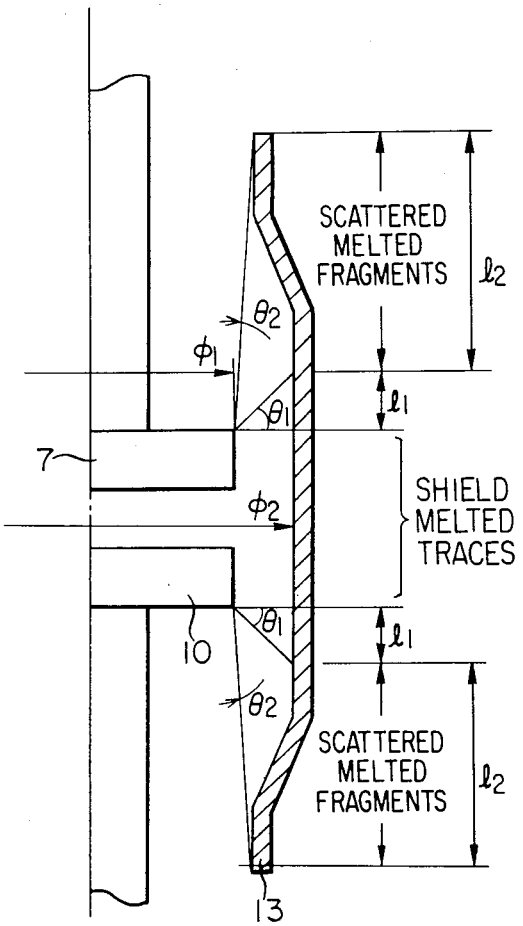
FIG. 2 PRIOR ART
FIG. 2 is an explanatory view useful in explaining the operation of the conventional vacuum circuit interrupter.

Next, explanation will be made as to the function. FIG. 2 is a graph showing the distribution of the scattered melted fragments of the shield with respect to the conventional shield structure.

As seen from this graph, only melted shield traces were found in the vicinity of the electrodes 7 and 10, and scattered fragments of the melted shield can be found in the region starting from the position beyond distance $l_1$ from the back side of the electrodes 7 and 10. It has been experimentally found that this distance $l_1$ can be determined by a space defined by an outer diameter $\phi_1$ of the electrodes 7 and 10 and by an inner diameter $\phi_2$ of the main shield 13 and also by an angle $\theta$ as measured from the back side of the electrodes 7 and 10). That is, it has been experimentally determined that the distance $l_1$ can be expressed as $$l_1=[(\phi_2-\phi_1)/2]\cdot\tan\theta_1$$

and it has been experimentally confirmed that $\theta=45°$.

Also, the distance $l_2$ beyond which no scattered fragments of the melted shield are found can be expressed as $$l_2=[(\phi_2-\phi_1)/2]\cdot\tan\theta_2$$

and it has been experimentally confirmed that $\theta_1\leqq 75°$.

These equations were confirmed to be correct up to a distance between the electrodes 7 and 10 and the shield 13 of 30 mm.

Therefore, the length L of the large-diameter portion centrally disposed in the main shield 13 is determined to be $$L = \text{stationary electrode thickness } t_1 + \text{main electrode gap length } t_2 + \text{movable electrode thickness } t_3 + 2l_1,$$

and the tapered angle $\theta$ of the transition from the large-diameter portion to the small-diameter portion is selected to be 80°~100°, whereby the melting of the shield can be forcedly and effectively prevented, thereby to prevent the scattering of the melted shield fragments in the radial direction which would degrade the dielectric recovery characteristics during current interruption and the withstand voltage after current interruption.

Further, it has also been experimentally confirmed that if the tapered angle is too small, the above advantageous effects cannot be obtained.

Figure 4:
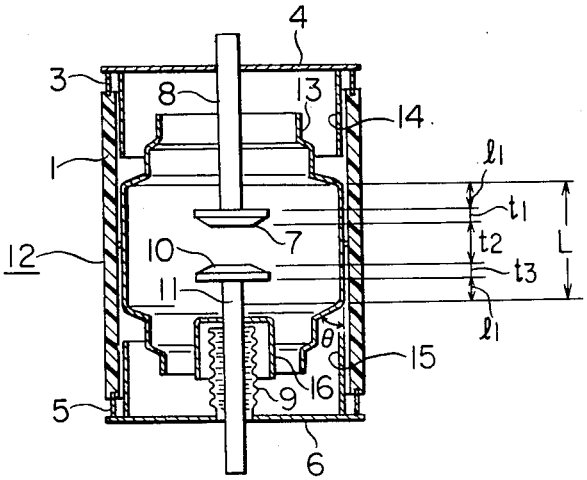
FIG. 4 is a cross sectional view showing vacuum interrupters of another embodiment of the present invention.
Figure 5:
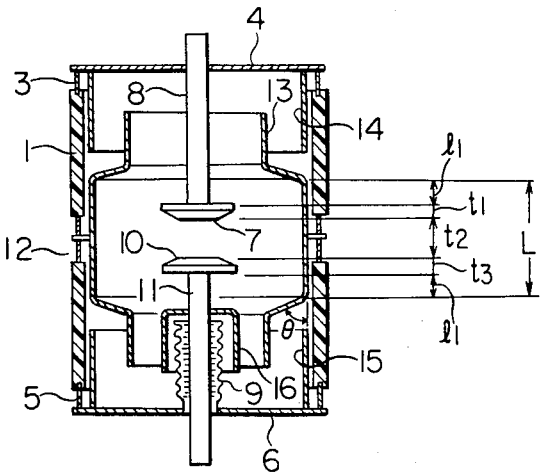
FIG. 5 is a cross sectional view showing vacuum interrupters of still another embodiment of the present invention.

While the main shield of the above embodiment has a single transition portion between the large-diameter portion and each small-diameter portion, two transition portions as shown in FIG. 4 or more transition portions may also be used with similar advantageous effects, and a similar advantageous effect can be obtained by the arrangement as shown in FIG. 5 in which two or more insulating vessels are used which are connected so that the main shield is disposed at the central portion.

Also, the present invention is not limited to vacuum circuit interrupters but is also applicable to vacuum discharge apparatus such as a vacuum fuse.

As has been described, according to the present invention, the adverse effects of the melted shield fragments to the dielectric recovery characteristics and the withstand voltage characteristics can be reduced by selecting a suitable shield length of the large-diameter portion and by selecting the tapered angle at the transition portion from the large-diameter portion to the small-diameter portion to be 80°~100°.

What is claimed is:

1. A vacuum circuit interrupter comprising a vacuum vessel, at least a pair of a separable stationary electrode and a movable electrode in said vessel, and a main shield concentrically surrounding the electrodes, said main shield having a large-diameter portion at the central portion and a small-diameter portion at opposite ends, the axial length L of said large-diameter portion of said main shield being the length expressed by:

$$L = \text{stationary electrode thickness } t_1 + \text{electrode gap length } t_2 + \text{movable electrode thickness } t_3 + 2\frac{(\phi_2+\phi_1)}{2}\tan(45°\sim 75°)$$

where, $\phi_2$=inner diameter of the large-diameter portion of main shield, and $\phi_1$=outer diameter of the electrode, and that the tapered angle from the large-diameter portion to the small-diameter portion is selected to be 80°~100°.

2. A vacuum circuit interrupter as claimed in claim 1 wherein a plurality of transitions from the large-diameter portion to the small-diameter portion are provided.

3. A vacuum circuit interrupter as claimed in claim 1 wherein said vacuum vessel is composed of at two or more insulating cylinders having a connection portion therebetween and said main shield is supported at said connection portion.

4. A vacuum circuit interrupter as claimed in claim 2 wherein said vacuum vessel is composed of at two or more insulating cylinders having a connection portion therebetween and said main shield is supported at said connection portion.

* * * * *